United States Patent [19]

Kelly et al.

[11] Patent Number: 4,759,649

[45] Date of Patent: Jul. 26, 1988

[54] DUAL AXIS PAPER DRIVE

[75] Inventors: Kieran B. Kelly; William R. Huseby; Robert P. Callaway; Chris A. Rasmussen, all of Vancouver, Wash.

[73] Assignee: Hewlett-Packard Company, Palo Alto, Calif.

[21] Appl. No.: 18,242

[22] Filed: Feb. 24, 1987

[51] Int. Cl.[4] ..... B41J 11/28; B41J 15/16

[52] U.S. Cl. ..... 400/616.3; 400/618

[58] Field of Search ..... 400/618, 616, 616.1, 400/616.2, 616.3; 226/76, 108

[56] References Cited

U.S. PATENT DOCUMENTS

| | | | |
|---|---|---|---|
| 2,080,524 | 6/1937 | Allen | 400/616.2 |
| 2,994,247 | 8/1961 | Baptista | 226/76 X |

FOREIGN PATENT DOCUMENTS

| | | | |
|---|---|---|---|
| 0153859 | 9/1985 | European Pat. Off. | 400/618 |
| 0039980 | 3/1982 | Japan | 400/616.1 |
| 0193384 | 11/1982 | Japan | 400/618 |
| 0148785 | 9/1983 | Japan | 400/618 |

*Primary Examiner*—Charles Pearson

*Attorney, Agent, or Firm*—S. A. Kassatly; Bloor Redding, Jr.

[57] ABSTRACT

Method and apparatus are provided for moving perforated continuous paper (10) through a dual axis printer (12), with both axes (14, 30) driven, while regulating the feed with the perforations and maintaining a controlled tension (38*a*) in the paper between the two driven axes. The novel approach in this invention is the addition of a set of spring-loaded friction surfaces (56*a*–62*a*), incorporated into a gear transmission (50), which limit the amount of torque which can be transmitted to the unregulated drive axis, with the direct effect of controlling the tension in the paper between the two axes.

In order to create this tension, the unregulated axis is driven at a slightly greater speed than the regulated axis (with speed measured in terms of inches of paper per revolution of the driven gear (20)). In normal operation, the slack in the paper is taken up, to the point at which the tension is at the correct level, and then enough slip occurs at the friction surfaces to drive the same amount of paper at both the regulated drive (16) and unregulated drive (32). The unregulated drive is only overdriven slightly (e.g., about 0.2%) to allow accurate feeding of single sheets (which are not driven by the regulated drive). This slight overdrive requires only minimal slip at the friction surfaces when driving continuous paper and thus keeps the amount of wear small.

17 Claims, 2 Drawing Sheets

DUAL AXIS PAPER DRIVE

TECHNICAL FIELD

The present invention relates to printers, and, more particularly, to dual axis printers, adapted to move perforated continuous paper therethrough.

BACKGROUND ART

In a dual axis printer, with pin wheels used on one axis to regulate the amount of paper driven through the printer, it is impossible to drive exactly the same amount of paper with the platen, which is colinear with the other axis. This is because it is impossible to manufacture the platen with exactly the correct diameter. As a result, either more or less paper is driven at the platen paper drive.

If less paper is driven there, then paper tends to bunch up between the two axes and eventually jams. If more paper is driven there, and if paper cannot slip at the platen, then the tension builds between the axes until the paper tears.

Some printers feed less paper with the platen, in which case the excess paper is pushed past the platen by the pin feed drive. A problem with this method is that the paper tends to float slightly off the platen, making it difficult to control the spacing between the printhead and the paper. In addition, paper can be difficult to control when pushed, especially in a humid environment.

Other printers feed more paper with the platen, in which case the paper must slip at the platen as tension builds between the two axes. The problem with this method is that it is very difficult to control the amount of tension in the paper because it is very difficult to control the coefficient of friction between the paper and the platen, especially under a variety of environmental conditions. The effect on paper tension due to variations in the platen coefficient of friction is non-linear. Small percentage changes in the coefficient of friction will result in greater percentage changes in the paper tension.

DISCLOSURE OF INVENTION

In accordance with the invention, tension in that portion of the paper between the two axes is controlled by providing a torque limiter assembly on the platen axis. The torque limiter assembly comprises a torque plate, mounted on the platen shaft in such a manner that it cannot rotate and can transmit the required torque, and a platen gear, mounted on the platen shaft adjacent the torque plate in such a manner that it can freely rotate. The platen gear is linked to the motor which drives the pin wheel shaft. The torque plate is provided with a controlled surface finish on the side facing the platen gear, which provides the requisite friction surface for the operation of the invention.

The torque plate and platen gear are preferably maintained in spring-loaded operative association by a slipper washer, a slippee washer, a spring, a stop washing and a retainer means. The slipper washer, which is adjacent the platen gear and on the opposite side from the torque plate, comprises a material having a comparatively low coefficient of friction to encourage slip between the platen gear and the slipper washer or between the slipper washer and the slippee washer.

In the invention, the control of the paper tension is done by the torque limiter assembly, which comprises a set of low cost, easy-to-manufacture, easy-to-control parts which are not particularly affected by expected environmental conditions. Parts which are difficult to control, such as the platen, or are very difficult to control, such as the paper, are no longer critical in determining the performance of the printer. In addition, the invention allows the use of a platen having a high coefficient of friction, which reduces the amount that the paper tends to lift off the platen when a Z-fold (the fold in the continuous paper which enables it to be stacked) passes the platen.

In the product where this invention is used, the spacing between the printhead and the paper is important, so it is important to keep the paper as tight against the platen as possible. The invention also transmits enough torque to feed single sheets of paper with the platen paper drive only. The ability to have a high coefficient of friction between the platen and the paper makes these single sheets easy to load and control.

BEST MODES FOR CARRYING OUT THE INVENTION

Figure 1:
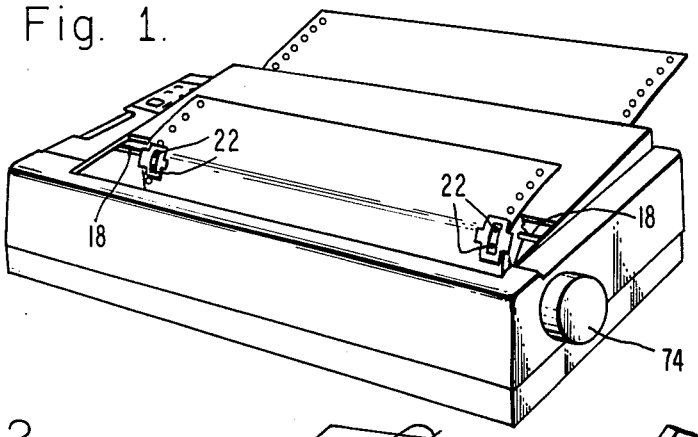
FIG. 1 is a perspective view of a printer adapted to suitably employ the teachings of the invention.

Method and apparatus are provided for moving continuous paper 10 through a dual axis printer, shown generally at 12. The printer 12 is the type with both axes driven, while regulating the feed and maintaining a controlled tension in the paper 10 between the two driven axes. The continuous paper 10 may provided with perforations 10a, as shown in FIG. 1, or may be unperforated.

Figure 2:
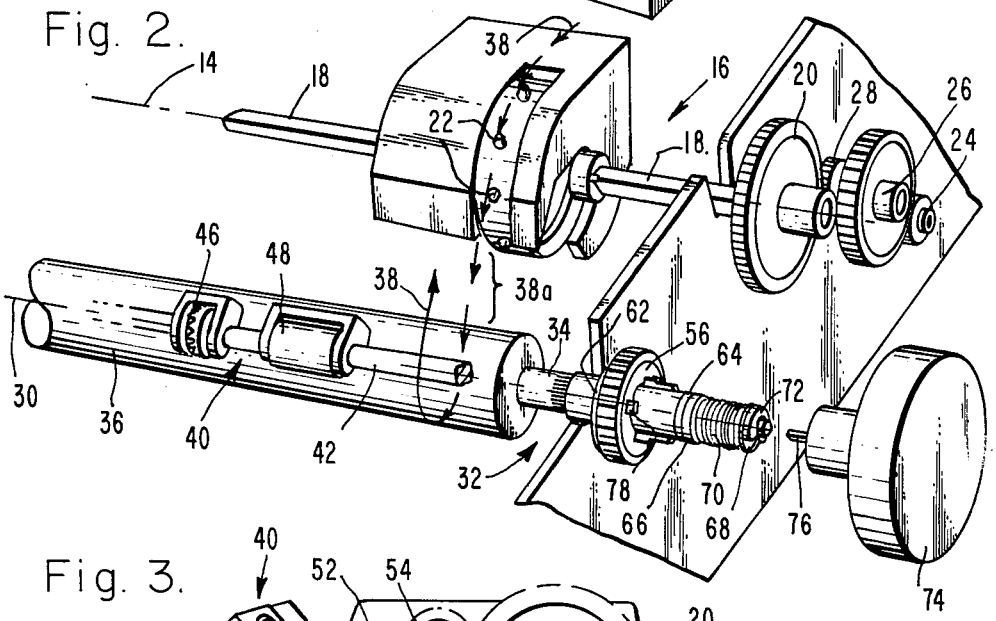
FIG. 2 is a perspective view of a portion of the printer of FIG. 1, showing the relationship of the paper moving apparatus with the apparatus of the invention.

The first axis is denoted 14, and is that axis associated with the pin feed paper drive, shown generally at 16. The pin feed paper drive 16, which is also known as the regulated drive, comprises a shaft 18, colinear with the axis 14, driven by a pin feed gear, or driven gear, 20. There are two pin wheels 22, one of which is shown in FIG. 2, on the shaft 18, one to engage each side of the perforated paper 10. As is conventional, the pin wheels 22 are laterally adjustable along the shaft 18. The pin feed drive 16 is driven by a motor (not shown), coupled by means of a pinion gear 24 on a shaft thereof, at the appropriate speed. Gears 26, 28 transmit the rotary motion from the pinion gear 24 to the pin feed gear 20.

The second axis is denoted 30 and is that axis associated with the platen paper drive, shown generally at 32. The platen paper drive 32, which is also known as the unregulated drive, comprises a shaft 34, colinear with the axis 30, on which platen 36 is mounted. The perforated paper 10 wraps partially around the platen 36 after engaging the pin wheels 22. The course the paper 10 takes is indicated in FIG. 2 by arrows 38.

The direction of the paper 10 may be unidirectional, as in the embodiment disclosed herein. However, the assembly of the invention is inherently bidirectional.

Figure 3:
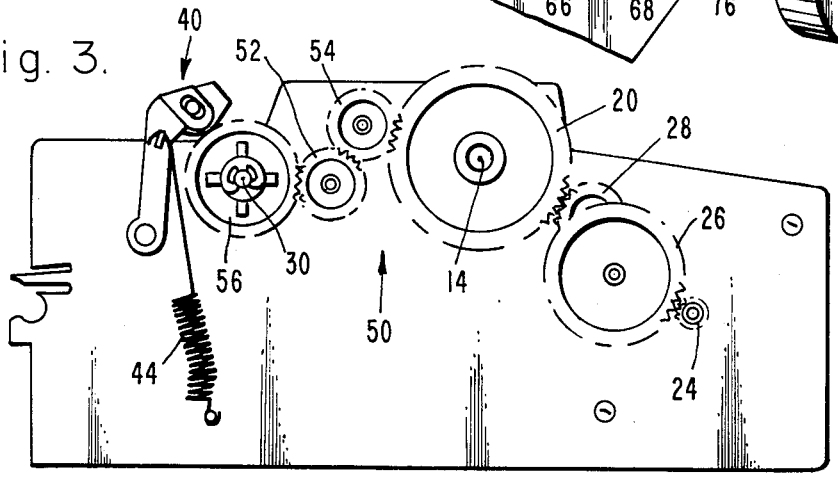
FIG. 3 is a side elevational view of the printer, illustrating the transmission gear arrangement employed in the invention.

A paper bail 40 comprises a shaft 42, held against the platen 36 by a spring 44 (FIG. 3). A set of laterally adjustable paper clamp rollers 46, 48 (one each is depicted in FIG. 2) maintain the paper 10 against the platen 36.

The novel approach in this invention is the addition of a set of spring-loaded friction surfaces, incorporated into a gear transmission, shown generally at 50, which limit the amount of torque which can be transmitted to the unregulated drive axis 30, with the direct effect of controlling the tension in the paper between the two axes 14, 30.

In order to create this tension, the unregulated axis 30 is driven at a slightly greater speed than the regulated axis 14 (with speed measured in terms of inches of paper per revolution of the driven gear 20). In normal operation, the slack in the paper 10 is taken up, to the point at which the tension is at the correct level, and then enough slip occurs at the friction surfaces to drive the same amount of paper at both the regulated drive 16 and unregulated drive 32. The unregulated drive 32 is only overdriven slightly (e.g., about 0.2% in this particular implementation of the invention) to allow accurate feeding of single sheets (which are not driven by the regulated drive 16). This slight overdrive requires only minimal slip at the friction surfaces when driving continuous paper and thus keeps the amount of wear on these surfaces small.

There is a pair of idler gears 52, 54 driven by the pin feed gear 20, with their purpose being to allow the unregulated drive, or the platen paper drive, 32 to be positioned away from the pin feed paper drive, 16. These gears are important to this particular implementation of the invention, and may be deleted or modified in other implementations.

A platen gear 56 is a part of the platen paper drive 32, being on the same axis 30 as the platen 36. The platen gear 56 provides mechanical coupling from the motor through the pin feed gear 20 by means of the idler gears 52, 54.

Figure 4:
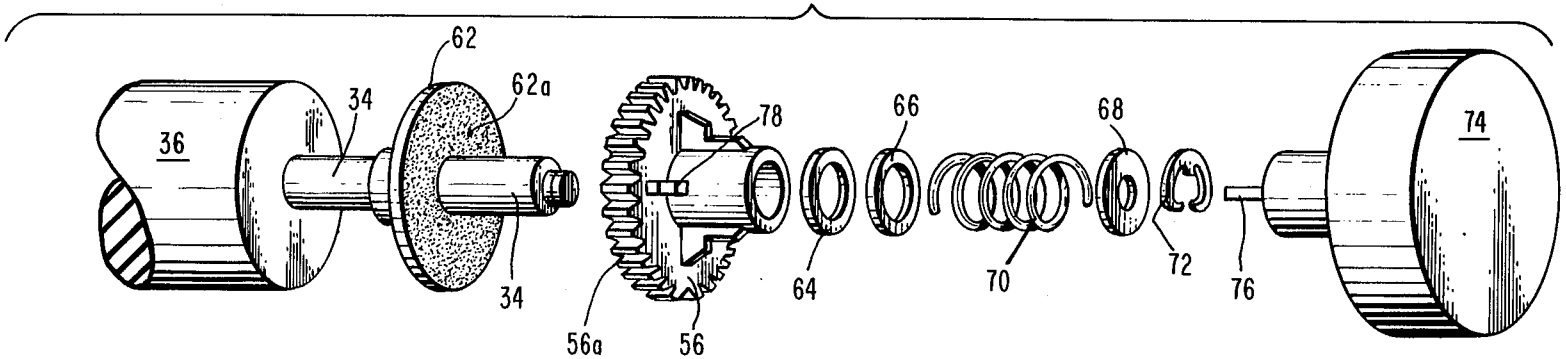
FIG. 4 is an exploded, perspective view, showing the arrangement of parts comprising the apparatus of the invention.

A torque limiter assembly 60, shown in FIG. 4, is provided which is operatively associated with the platen 36, which includes the platen shaft 34 at the end. Onto this platen shaft 34, in such a manner that it cannot rotate and can transmit the required torque, is pressed a torque plate 62. The torque plate 62 is a flat metal plate, with a controlled surface finish on the side 62*a*which faces the platen gear 56.

In one embodiment of the invention, the surface finish is maintained within a roughness range of approximately 0.2 to 0.3 μm RMS average. In addition, the texture of the surface is substantially random, that is, not oriented in either a radial or circumferential direction. These parameters are controlled with finishing operations applied to the surface 62*a* of the torque plate 62.

The platen gear 56 is free to rotate on the platen shaft 34, and is driven by the idler gears 52, 54, as described above. As it is free to rotate, the platen gear 56 cannot transmit significant torque to the platen 36 except through friction between the face 56*a* of the platen gear and the face 62*a* of the torque plate 62, or through friction between the platen gear and washers 64, 66, 68, spring 70, and E-ring 72. Because of the larger contact radius at the torque plate 62, most of the torque is transmitted at this interface (56*a*–62*a*).

The normal force which creates the friction force required to transmit torque is created by the spring 70, which is compressed during installation. The spring 70 is trapped between two washers, the slippee washer 66 and the stop washer 68, which spread the force over a larger area and help to prevent damage caused by concentrated forces at either end of the spring 70. The slipper washer 64 comprises a material with a low coefficient of friction and serves the purpose of encouraging slip to occur between the platen gear 56 and the slipper washer 64 or the slipper washer 64 and the slippee washer 66. In doing so, minimal torque is transmitted through the spring 70, which limits the tendency to wind or unwind it, thus reducing its influence on the overall torque transmitted and improving torque regulation.

The E-ring 72 is a retainer which captures the platen gear 56, washers 64, 66, 68, and spring 70, and in doing so, maintains the spring in its compressed state.

The various parts, with the exception of the slipper washer 64, comprise conventional metal. For example, the washers 66 and 68 may comprise stainless steel. The slipper washer comprises polytetrafluorethylene, nylon or other material having a low coefficient of friction and the requisite strength.

A platen knob 74 fits over the washers 64, 66, 68, spring 70, and retainer 72. The knob 74 is provided with a pair of oppposed fingers 76 (one of which is visible), which engage corresponding studs 78 on the platen gear 56 in snap-fit releasable fashion. the plate knob 74 is attached to the platen gear 56 to allow the user to adjust transmission 50 directly. The platen knob 74 is located to maintain the benefits of the invention even when the user is delivering the motive force usually supplied by the motor.

In operation, the frictional forces between the various parts discussed above keep the platen gear 56 and the platen 36 locked together until the tension in the paper puts enough drag on the platen such that the frictional force between the platen gear and the other parts of the system is not enough to transmit any more torque than that which is required to maintain that controlled tension.

After that tension is reached, the platen gear 56 will slip relative to the platen 36 by the amount of overdrive built into the system. The overdrive amount is the difference in surface speed between the platen 36 and the pin wheels 22, and is determined by the number of pins on the pin wheels, the gear ratio between the pin feed gear 20 and the platen gear 56, and the true diameter of the platen.

The controlled tension in the paper is depicted as zone 38a of the paper path 38 in FIG. 2. The amount of controlled tension is directly related to the amount of torque transmitted and is calibrated by selecting the following parameters: coefficients of friction between adjacent parts, spring force, and radii at which the forces are applied. The minimum torque is selected to deliver enough torque to overcome friction in the bearings and other parts of the paper drive system, and to deliver enough additional torque to drive paper through the printer (including single sheets, which do not use the pin feed drive 16 at all). The maximum torque is selected to limit any damage to the paper perforations which would be caused by the controlled tension being too great (the perforations will "egg" or tear if the tension is too great). Such selections are easily within the ability of the person skilled in the art without undue experimentation. For example, in one particular embodiment of the invention, the range of torques is maintained between about 7 and 12 in-oz.

INDUSTRIAL APPLICABILITY

The torque limiter assembly disclosed herein is suitably employed in dual axis paper drives for advancing continuous paper in printers.

Thus, there has been disclosed a dual axis paper drive system which incorporates a torque limiter assembly to control the tension of continuous paper between pin wheels driving the paper and the platen on which the paper is printed. Various changes and modifications of an obvious nature may be made by those skilled in the art, and all such changes and modifications are deemed to be within the scope of the invention, as defined by the appended claims.

What is claimed is:

1. Apparatus for controlled movement of continuous paper through a dual axis printer, a first axis of which is associated with a pin feed paper drive and a second axis of which is associated with a platen paper drive, said first and second axes being parallel and spaced apart, said pin feed paper drive comprising a first shaft colinear with said first axis driven by a drive means and having thereon two pin wheels, one to engage each side of said paper, and said platen paper drive axis comprising a second shaft colinear with said second axis on which a platen is mounted, said apparatus comprising (a) a torque limiter assembly for adjusting tension in said paper between said axes, said torque limiter assembly mounted on said platen shaft and including slippable friction surfaces, and (b) overdrive means for driving said platen shaft slightly faster than said pin feed shaft.

2. The apparatus of claim 1 wherein said drive means includes a pin feed gear mounted on said first shaft, coupled to a motor.

3. The apparatus of claim 1 wherein said torque limiter assembly comprises a torque plate fixedly mounted on said platen shaft and an adjacent platen gear, said torque plate having a surface facing said platen gear provided with a substantially random surface finish and said platen gear freely rotatably mounted on said platen shaft and linked to said drive means.

4. The apparatus of claim 3 wherein said surface of said torque plate has a roughness of about 0.2 to 0.3 μm RMS average.

5. The apparatus of claim 3 wherein siad platen gear is maintained adjacent said torque plate by a slipper washer, a slippee washer, a spring, a stop washer and a retainer means, serially mounted on said second shaft.

6. The apparatus of claim 5 wherein said slipper washer comprises a material having a comparatively low coefficient of friction to encourage slip between said platen gear and said slipper washer or between said slipper washer and said slippee washer.

7. The apparatus of claim 6 wherein said slipper washer comprises a material selected from the group consisting of polytetrafluorethylene and nylon.

8. Apparatus for controlled movement of perforated continuous paper through a dual axis printer, a first axis of which is associated with a pin feed paper drive and a second axis of which is associated with a platen paper drive, said first and second axes being parallel and spaced apart, said pin feed paper drive comprising a first shaft colinear with said first axis driven by a pin feed gear from a motor and having thereon two pin wheels, one to engage each side of said perforated paper, and said platen paper drive axis comprising a second shaft colinear with said second axis on which a platen is mounted, said apparatus comprising a torque limiter assembly for adjusting tension in said paper between said axes, wherein said torque limiter assembly comprises a torque plate fixedly mounted on said platen shaft and an adjacent platen gear, said torque plate having a surface facing said platen gear provided with a substantially random surface finish, said platen gear freely rotatably mounted on said platen shaft and linked to said motor, and wherein said platen gear is maintained adjacent said torque plate by a slipper washer, a slippee washer, a spring, a stop washer and a retainer means serially mounted on said second shaft, said slipper washer comprising a material having a comparatively low coefficient of friction to encourage slip between said platen gear and said slipper washer or between said slipper washer and said slippee washer.

9. The apparatus of claim 8 wherein said slipper washer comprises a material selected from the group consisting of polytetrafluroethylene and nylon.

10. The apparatus of claim 8 wherein said surface of said torque plate has a roughness of about 0.2 to 0.3 μm RMS average.

11. A method of controlling tension in continuous paper between two axes of a dual axis paper drive apparatus, a first axis of which is associated with a pin feed paper drive and a second axis of which is associated with a platen paper drive, said first and second axes being parallel and spaced apart, said pin feed paper drive comprising a first shaft colinear with said first axis driven by a drive means and having thereon two pin wheels, one to engage each side of said paper, and said platen paper drive axis comprising a second shaft colinear with said second axis on which a platen is mounted, said method comprising (a) adjusting tension in said paper between said axes by a torque limiter assembly mounted on said platen shaft and capable of slipping with respect thereto and (b) overdriving said platen shaft slightly with respect to said pin feed shaft.

12. A method of controlling tension in perforated continuous paper between two axes of a dual axis paper drive apparatus, a first axis of which is associated with a pin feed paper drive and a second axis of which is associated with a platen paper drive, said first and second axes being parallel and spaced apart, said pin feed paper drive comprising a first shaft colinear with said first axis driven by a pin feed gear from a motor and having thereon two pin wheels, one to engage each side of said perforated paper, and said platen paper drive axis comprising a second shaft colinear with said second axis on which a platen is mounted, said method comprising (a) adjusting tension in said paper between said axes by a torque limiter assembly comprising a torque plate fixedly mounted on said platen shaft and an adjacent platen gear, said torque plate having a surface facing said platen gear provided with a substantially random surface finish, said platen gear freely rotatably mounted on said platen shaft and linked to said motor, and wherein said torque plate and said platen gear are forced together by a slipper washer, a slippee washer, a spring, a stop washer and a retainer means serially mounted on said second shaft, sid slipper washer comprising a material having a comparatively low coefficient of friction to encourage slip between said platen gear and said slipper washer or between said slipper washer and said slippee washer and (b) overdriving said platen shaft slightly with respect to said pin feed shaft.

13. Apparatus for controlled movement of continuous paper through a dual axis printer, a first axis of which is associated with a pin feed paper drive and a second axis of which is associated with a platen paper drive, said first and second axes being parallel and spaced apart, said pin feed paper drive comprising a first shaft colinear with said first axis driven by a drive means and having thereon two pin wheels, one to engage each side of said paper, and said platen paper drive axis comprising a second shaft colinear with said second axis on which a platen is mounted, said apparatus comprising a torque limiter assembly for adjusting tension in said paper between said axes, said torque limiter assembly comprising a torque plate fixedly mounted on said platen shaft and an adjacent platen gear, said torque plate having a surface facing said platen gear provided with a substantially random texture surface finish and said platen gear freely rotatably mounted on said platen shaft and linked to said drive means, said platen gear maintained adjacent said torque plate by a slipper washer, a slippee washer, a spring, a stop washer and a retainer means, serially mounted on said second shaft.

14. The apparatus of claim 13 wherein said drive means includes a pin feed gear mounted on said first shaft, coupled to a motor.

15. The apparatus of claim 13 wherein said surface of said torque plate has a roughness of about 0.2 to 0.3 $\mu$m RMS average.

16. The apparatus of claim 13 wherein said slipper washer comprises a material having a comparatively low coefficient of friction to encourage slip between said platen gear and said slipper washer or between said slipper washer and said slippee washer.

17. The apparatus of claim 16 wherein said slipper washer comprises a material selected from the group consisting of polytetrafluoroethylene and nylon.

* * * * *